US006252581B1

(12) United States Patent
Fukazawa

(10) Patent No.: US 6,252,581 B1
(45) Date of Patent: Jun. 26, 2001

(54) COLOR IMAGE SIGNAL GENERATOR AND STORAGE MEDIUM

(75) Inventor: Naomitsu Fukazawa, Osaka (JP)

(73) Assignee: Capcom Co.. Ltd., Osaka (JP)

( * ) Notice: Subject to any disclaimer, the term of this patent is extended or adjusted under 35 U.S.C. 154(b) by 0 days.

(21) Appl. No.: 09/258,988

(22) Filed: Feb. 26, 1999

(30) Foreign Application Priority Data

Jul. 29, 1998 (JP) ..... 10-213657

(51) Int. Cl.[7] ..... G09G 5/04
(52) U.S. Cl. ..... 345/155; 345/153
(58) Field of Search ..... 345/155, 153

(56) References Cited

U.S. PATENT DOCUMENTS 4,737,772 * 4/1988 Nishi et al. ..... 345/153
5,170,170 * 12/1992 Taylor ..... 345/155
5,384,582 * 1/1995 Keith et al. ..... 345/155
5,808,630 * 9/1998 Pannell ..... 345/153
6,034,804 * 3/2000 Greene ..... 345/155

* cited by examiner

*Primary Examiner*—Jeffery Brier
*Assistant Examiner*—Anthony Blackman
(74) *Attorney, Agent, or Firm*—Michael D. Bednarek; Shaw Pittman

(57) ABSTRACT

A color image signal generator is provided for generating red, green and blue analog image signals based on first red, green and blue image data and on first brightness data. Each of the first red, green and blue image data has a predetermined first bit number, while the first brightness data has a predetermined second bit number. The color image signal generator includes a brightness data modifier for providing second brightness data based on the first brightness data, so that the second brightness data has a predetermined third bit number which is greater than the second bit number. The color image signal generator also includes a data multiplier arranged to multiply the second brightness data with the first red, green and blue image data. As a result of multiplication, second red, green and blue image data are output, so that each of the second image data has a fourth bit number which is greater than the first and the third bit numbers. The color image signal generator further includes a digital-to-analog converter for converting predetermined top bits of each of the second image data into analog signals.

17 Claims, 6 Drawing Sheets

| | FIRST CONVERSION TABLE | SECOND CONVERSION TABLE |
|---|---|---|
| FIRST BRIGHTNESS DATA | SECOND BRIGHTNESS DATA | SECOND BRIGHTNESS DATA |
| 0 | 10 | 55 |
| 1 | 20 | 59 |
| 2 | 30 | 5E |
| 3 | 40 | 62 |
| 4 | 50 | 68 |
| 5 | 60 | 6E |
| 6 | 70 | 74 |
| 7 | 80 | 7C |
| 8 | 90 | 84 |
| 9 | A0 | 8E |
| A | B0 | 9A |
| B | C0 | A7 |
| C | D0 | B7 |
| D | E0 | CA |
| E | F0 | E2 |
| F | 100 | 100 |

COLOR IMAGE SIGNAL GENERATOR AND STORAGE MEDIUM

BACKGROUND OF THE INVENTION

1. Field of the Invention

The present invention relates to a color image signal generator used for a video game machine. More particularly, the present invention relates to a color image signal generator arranged to generate red, green and blue image signals for each pixel in accordance with red, green and blue image data and with brightness data. The present invention also relates to a storage medium for storing programs to control such a color image signal generator.

2. Description of the Related Art

A conventional video game machine may incorporate many electronic components and units for enabling a player (or players) to enjoy a video game by the video game machine. Among these units may be a color image signal generator arranged for generating red, green and blue image signals (analog signals) based on red, green and blue image data supplied from a look-up table incorporated in the video game machine.

Typically, the look-up table may be made up of a RAM (random access memory). The red, green and blue image data from the look-up table are converted into corresponding red, green and blue analog signals by digital-to-analog converters (D/A converters).

The analog image signals from the color image signal generator are supplied to a display unit. As a result, desired characters (each of which is made up of plural "objects") are visually presented on the screen of the display unit.

Disadvantageously, the memory of the conventional look-up table has not been put to effective use. Specifically, the bit number of a memory in general is eight (8) bits or sixteen (16) bits. Color image data are made up of three kinds of data, namely, red, green and blue image data. Thus, supposing that the look-up table is of 16-bit and five (5) bits are used for each color, one bit in the look-up table remains to be unused.

For avoiding the above problem, the applicant of the present application once proposed a color image signal generator shown in FIG. 6 of the accompanying drawings. The illustrated signal generator includes a look-up table 51, buffers 52Ra–52Rd, 52Ga–52Gd and 52Ba–52Bd, three-state gates 53Ra–53Rd, 53Ga–53Gd and 53Ba–53Bd, amplifiers 54R, 54G and 54B, and resistors Rra–Rrh, Rga–Rgh and Rba–Rbh.

The resistors Rra, Rga and Rba may have a resistance of 1600Ω, the resistors Rrb, Rgb and Rbb may have a resistance of 800Ω, the resistors Rrc, Rgc and Rbc may have a resistance of 400Ω, the resistors Rrd, Rgd and Rbd may have a resistance of 200Ω, the resistors Rre, Rge and Rbe may have a resistance of 800Ω, the resistors Rrf, Rgf and Rbf may have a resistance of 400Ω, the resistors Rrg, Rgg and Rbg may have a resistance of 200Ω, and the resistors Rrh, Rgh and Rbh may have a resistance of 100 Ω.

The look-up table 51 outputs 4-bit red image data, 4-bit green image data and 4-bit blue image data in parallel. The 4-bit red image data are supplied to the buffers 52Ra–52Rd. Similarly, the 4-bit green image data are supplied to the buffers 52Ga–52Gd, while the 4-bit blue image data are supplied to the buffers 52Ba–52Bd.

The look-up table 51 also outputs 4-bit brightness data together with the three color image data. The brightness data are supplied to the three-state gates 53Ra–53Rd, 53Ga–53Gd and 53Ba–53Rd via their control terminals. As is shown, the input terminals of the respective three-state gates 53Ra–53Rd, 53Ga–53Gd and 53Ba–53Bd are grounded.

It is now supposed that the combination of the four resistors Rra–Rrd in parallel has an equivalent resistance of R1, while the combination of the four resistors Rre–Rrh in parallel has an equivalent resistance of R2. In this instance, the output voltage from the buffers 52Ra–52Rd is divided into two lower voltages in accordance with the ratio of R1 to R2, and only one of the lower voltages is supplied to the amplifier 54R. The supplied data are amplified by the amplifier 54R and then output as analog red image signals.

Similarly, analog green image signals are obtained from the amplifier 54G, while analog blue image signals are obtained from the amplifier 54B.

According to the color image signal generator shown in FIG. 6, the look-up table 51 can be used effectively. Supposing that the look-up table 51 is a 16-bit memory, 12 bits may be used for the three kinds of image data (4 bits for each color) and the remaining 4 bits may be used for the brightness data. In this way, it is possible to use all of the 16 bits of the look-up table 51, thereby enabling provision of sixty five thousand five hundred and thirty six (65536) colors in total.

However, the color image signal generator of FIG. 6 has been found disadvantageous in the following points.

Specifically, the signal generator of FIG. 6 is an analog circuit using the resistors Rra–Rrh, Rga–Rgh and Rba–Rbh for example. In general, analog circuits tend to have constraints on designing freedom. Further, it is difficult to generate accurate color image signals with the use of an analog circuit. Referring to the signal generator of FIG. 6, the buffers 52Ra–52Rd, 52Ga–52Gd and 52Ba–52Bd are TTL (transistor-transistor-logic) circuits. In this case, the high-level output voltage from these buffers will unfavorably vary due to variations in load. Thus, it becomes difficult to maintain an accurate image signal level in accordance with the combination of the image data and the brightness data.

Still further, when the resistances of the resistors Rra–Rrh, Rga–Rgh and Rba–Rbh are increased, the delay time in signal transmission will become longer. On the other hand, when the above resistances are decreased, the power consumption of the color image signal generator tends to become unduly larger or the input voltage to the amplifiers 54R, 54G and 54B may decrease. Additionally, in the signal generator of FIG. 6, the variable range of image signals based on the brightness data is unfavorably limited, so that it cannot be expected to obtain satisfactory results of fade-in or fade-out.

SUMMARY OF THE INVENTION

It is, therefore, an object of the present invention is to provide a color image signal generator which eliminates or reduces the above-described problems.

Another object of the present invention is to provide a video game machine incorporating such a color image signal generator.

Still another object is to provide a storage medium advantageously used in such a color image signal generator.

According to a first aspect of the present invention, there is provided a color image signal generator for generating red, green and blue analog image signals based on first red, green and blue image data and on first brightness data, each of the first red, green and blue image data having a predetermined first bit number, the first brightness data having a predetermined second bit number, the color image signal generator comprising:

a brightness data modifier for providing second brightness data based on the first brightness data, the second brightness data having a predetermined third bit number which is greater than the second bit number;

a data multiplier arranged to multiply the second brightness data with the first red, green and blue image data for output of second red, green and blue image data, each of the second red, green and blue image data having a fourth bit number which is greater than the first and the third bit numbers; and a digital-to-analog converter for converting predetermined top bits of each of the second red, green and blue image data into analog signals.

With such an arrangement, the second brightness data (digital data) are multiplied with the first image data (digital data) before the data multiplier converts the second image data (digital data) into analog data. Thus, all of the bits of a look-up table are advantageously utilized, while accurate color image signals can be generated.

According to a preferred embodiment, the first bit number is equal to the second bit number.

The brightness data modifier may be provided with at least one data conversion table for changing the first brightness data to the second brightness data.

Preferably, the brightness data modifier may be provided with a plurality of data conversion tables for changing the first brightness data to the second brightness data.

According to the preferred embodiment, the color image signal generator further comprises a conversion table selector for selecting one data conversion table among the plurality of data conversion tables. The conversion table selector may comprise a 1-bit register.

According to another preferred embodiment, the brightness data modifier may be provided with at least one numerical formula for changing the first brightness data to the second brightness data.

Advantageously, the brightness data modifier may be provided with a plurality of numerical formulas for changing the first brightness data to the second brightness data.

The brightness data modifier may comprise a brightness data modifying circuit.

The data multiplier may comprise three multiplying circuits for the first red, green and blue image data.

The digital-to-analog converter may comprise three digital-to-analog converting circuits for the second red, green and blue image data.

According to a second aspect of the present invention, there is provided a video game machine comprising a color image signal generator for generating red, green and blue analog image signals based on first red, green and blue image data and on first brightness data, each of the first red, green and blue image data having a predetermined first bit number, the first brightness data having a predetermined second bit number, the color image signal generator includes:

a brightness data modifier for providing second brightness data based on the first brightness data, the second brightness data having a predetermined third bit number which is greater than the second bit number;

a data multiplier arranged to multiply the second brightness data with the first red, green and blue image data for output of second red, green and blue image data, each of the second red, green and blue image data having a fourth bit number which is greater than the first and the third bit numbers; and a digital-to-analog converter for converting predetermined top bits of each of the second red, green and blue image data into analog signals.

The video game machine may further comprise a CPU for controlling the video game machine.

According to a preferred embodiment, the CPU may also serve as the brightness data modifier and the data multiplier.

According to a third aspect of the present invention, there is provided a storage medium for storing programs to control a color image signal generator used for generating red, green and blue analog image signals based on first red, green and blue image data and on first brightness data, each of the first red, green and blue image data having a predetermined first bit number, the first brightness data having a predetermined second bit number, the storage medium comprising:

a brightness data modifying program for providing second brightness data based on the first brightness data, the second brightness data having a predetermined third bit number which is greater than the second bit number; and a data multiplying program for multiplying the second brightness data with the first red, green and blue image data for output of second red, green and blue image data, each of the second red, green and blue image data having a fourth bit number which is greater than the first and the third bit numbers.

Advantageously, the data multiplying program may also serve to supply top bits of the second red, green and blue image data to a digital-to-analog converter of the color image signal generator.

The storage medium may comprise a CD-ROM. Alternatively, use may be made of a flexible disk or hard disk for the storage medium.

Other objects, features and advantages of the present invention will become clearer from the detailed description of preferred embodiments given below with reference to the accompanying drawings.

DETAILED DESCRIPTION OF THE PREFERRED EMBODIMENTS

The preferred embodiments of the present invention will be described below with reference to FIGS. 1 through 5B of the accompanying drawings.

Figure 1:
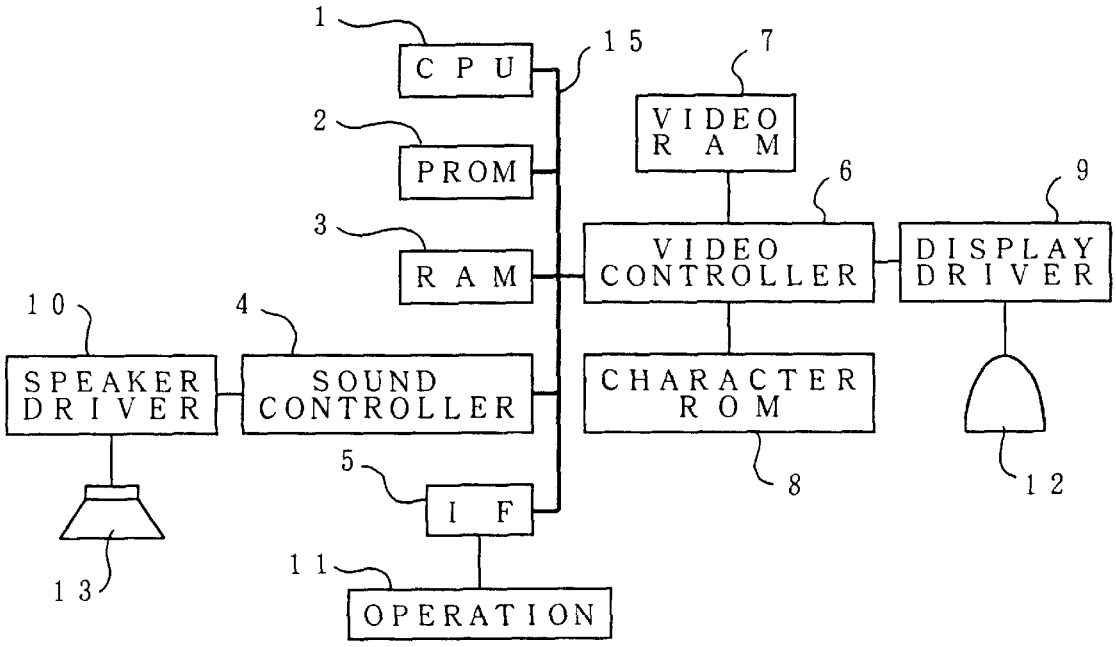
FIG. 1 is a block diagram showing principal components of a video game machine which incorporates a color image signal generator according to a first embodiment of the present invention.

Reference is first made to FIG. 1 which is a block diagram illustrating a video game machine incorporating a color image signal generator according to a first embodiment of the present invention. As is shown, the video game machine includes a CPU (central processing unit) 1, a PROM (programmable read-only memory) 2, a RAM (random-access memory) 3, a sound controller 4, an interface circuit 5, a video controller 6, a video RAM 7, a character ROM 8, a display driving circuit 9, a speaker driving circuit 10, an operating unit 11, a display unit 12, and a speaker 13.

The CPU 1, the PROM 2, the RAM 3, the sound controller 4, the interface circuit 5 and the video controller 6 are connected to each other via bus lines 15. The bus lines 15 include data bus lines, address bus lines and control bus lines.

The sound controller 4 is connected to the speaker driving circuit 10, which in turn is connected to the speaker 13. The interface circuit 5 is connected to the operating unit 11. The video controller 6 is connected to the video RAM 7, the character ROM 8 and the display driving circuit 9. The display driving circuit 9 is connected to the display unit 12.

In the embodiment shown in FIG. 1, use is made of a single operating unit 11, a single display unit 12 and a single speaker 13. However, the video game machine may be provided with more than one operating unit and/or an additional number of displaying units and/or speakers may be usable.

The CPU 1 controls the video game machine as a whole.

The PROM 2 is a non-volatile memory in which data can be written only once after its production. The PROM 2 stores various kinds of programs and data needed for enabling a user or player to play a game by the video game machine. The PROM 2 also stores color codes of the objects to appear in the game.

The RAM 3 provides a working area for the CPU 1 and stores various kinds of data.

The sound controller 4 generates aural data needed for providing background music and various kinds of sound effects.

The interface circuit 5 controls data communications between the operating unit 11 and the CPU 1.

The video controller 6 generates image data under the control of the CPU 1. Based on these image data, various kinds of objects (which constitute characters) are created on the screen of the display unit 12.

In general, animated pictures or graphics presented on the screen of a display unit are made up of a continuous series of "frames." Each frame is produced in accordance with a certain amount of image generating data. In the video game machine of the present invention, such image generating data corresponding to one frame are stored in the video RAM 7.

The image generating data corresponding to one frame have a predetermined number of bits. In the preferred embodiment, the bit number of the image generating data set is determined so that each pixel of the display unit 12 is allotted 9-bit data. The 9-bit data includes a 5-bit color code and 4-bit color specifying data. Assuming that an object to appear on the screen is made up of two hundred and fifty six (256=16×16) pixels, the above-mentioned 5-bit color code may be the same for all of the 256 pixels, whereas the 4-bit color specifying data may be different for them.

The image generating data (including a color code and color specifying data, as stated above) are supplied as an address to a look-up table in the video controller 6. Then, image data and brightness data will be output from the look-up table, as will be described later.

The character ROM 8 stores color specifying data for all of the pixels of each object.

The display driving circuit 9 drives the display unit 12 based on red, green and blue image signals supplied from the video controller 6.

The speaker driving circuit 10 generates driving signals for causing the speaker 13 to provide background music and suitable sound effects. The generation of such driving signals is performed in accordance with the aural data from the sound controller 4.

The operating unit 11 may be provided with a joystick (control stick) and several button switches. By manipulating these, the player of the video game can supply various kinds of operational signals or commands to the video game machine.

The display unit 12 may be provided with a raster scanning type CRT (cathode-ray tube). Animated pictures are presented on the screen of the CRT under the control of the display driving unit 9.

Figure 2:
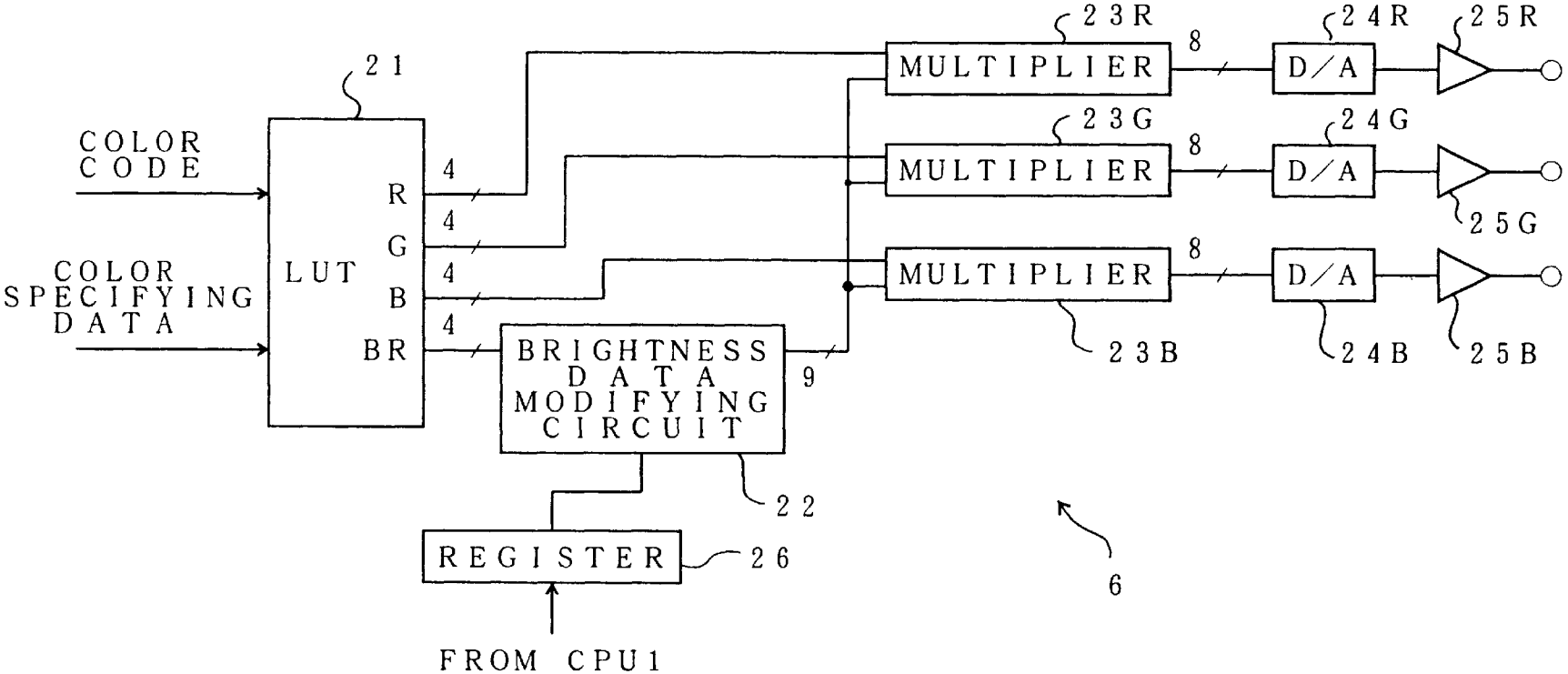
FIG. 2 is a block diagram showing principal components of the video controller of the video game machine shown in FIG. 1.

Reference will now be made to FIG. 2 which is a block diagram showing principal components of the video controller 6. As illustrated, the video controller 6 includes a look-up table (LUT) 21, a brightness data modifying circuit 22, first to third multiplying circuits 23R, 23G, 23B, first to third digital-to-analog (D/A) converting circuits 24R, 24G, 24B, first to third amplifiers 25R, 25G, 25B, and a 1-bit register 26.

The look-up table 21, which may be realized by a RAM, will output 4-bit red image data (first red image data), 4-bit green image data (first green image data) and 4-bit blue image data (first blue image data), when 9-bit image generating data (which are read out from the video RAM 7 by the video controller 6) are supplied to the look-up table. The look-up table 21 also outputs 4-bit brightness data (first brightness data) together with the above three kinds of image data.

For enabling the look-up table 21 to generate the 4-bit image data and brightness data, a suitable amount of data has to be present in the look-up table 21. However, these data are initially stored in the PROM 2 but not in the look-up table 21. When the power of the video game machine is turned on, the CPU 1 reads out the necessary data from the PROM 2 and writes them in the look-up table 21.

As can be seen from FIG. 2, the first red, green and blue image data are supplied to the first to the third multiplying circuits 23R, 23G and 23B, respectively. On the other hand, the first brightness data are supplied to the brightness data modifying circuit 22.

The brightness data modifying circuit 22 may be realized by a RAM. Upon receiving 4-bit first brightness data from the look-up table 21, the brightness data modifying circuit 22 outputs 9-bit brightness data (second brightness data) to the first to the third multiplying circuits 23R, 23G and 23B. In this manner, the brightness data modifying circuit 22 serves as converting means for changing 4-bit first brightness data to 9-bit second brightness data.

Figures 3A, 3B:
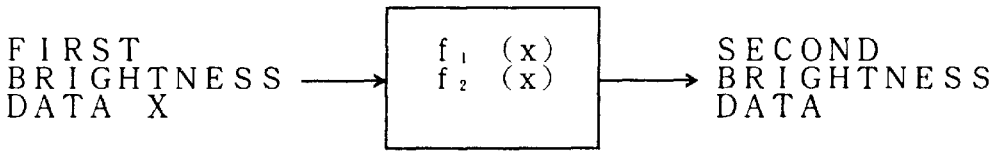
FIG. 3A illustrates a conversion table for converting a first brightness data into a second brightness data.
FIG. 3B illustrates a data converter using a plurality of numerical formulas.

As shown in FIG. 3A, according to the illustrated embodiment, two conversion tables (first and second conversion tables) are provided in the brightness data modifying circuit 22. Selection between the two conversion tables is performed based on a value at the register 26 (the value is set by the CPU 1). For instance, when the value at the register 26 is "0", the first conversion table may be used. When the value is "1", the second conversion table may be used.

Data written in the two conversion tables are initially stored in the PROM 2. When the power of the video game machine is turned on, the CPU 1 reads out these data from the PROM 2 and writes them in the brightness data modifying unit 22.

Instead of using a conversion table, use may be made of numerical formulas $f_1(X)$, $f_2(X)$, and so forth for converting first brightness data into second brightness data, as shown in FIG. 3B. In operation, one of the plural formulas may be selected by the CPU 1 for performing the desired conversion. Alternatively, a combination of more than one formula may be adopted for the same purpose.

Referring back to FIG. 2, the first multiplying circuit 23R multiplies the 4-bit first red image data from the look-up table 21 by the 9-bit second brightness data from the brightness data modifying circuit 22. Thus, 12-bit red image data (second red image data) are obtained. Then, the most significant eight bits (or top eight bits) of the second red image data are supplied to the first D/A converting circuit 24R. Here, the most significant eight bits of "100111010101" for example is "10011101".

Then, the most significant eight bits of the second red image data are converted into analog image data by the first D/A converting circuit 24R. The converted analog image data are supplied to the first amplifier 25R to be amplified thereby. Then, the amplified analog image data are supplied to the display driving circuit 9.

Similarly, the second multiplying circuit 23G multiplies the 4-bit first green image data (from the look-up table 21) by the 9-bit second brightness data (from the brightness data modifying circuit 22), whereby 12-bit green image data (second green image data) are obtained. Then, the most significant eight bits of the second green image data are supplied to the second D/A converting circuit 24G.

Then, the most significant eight bits of the second green image data are converted into analog image data by the second D/A converting circuit 24G. The converted analog image data are supplied to the second amplifier 25G to be amplified thereby. Then, the amplified analog image data are supplied to the display driving circuit 9.

Likewise, the third multiplying circuit 23B multiplies the 4-bit first blue image data (from the look-up table 21) by the 9-bit second brightness data (from the brightness data modifying circuit 22), whereby 12-bit blue image data (second blue image data) are obtained. Then, the most significant eight bits of the second blue image data are supplied to the third D/A converting circuit 24B.

Then, the most significant eight bits of the second blue image data are converted into analog image data by the third D/A converting circuit 24B. The converted analog image data are supplied to the third amplifier 25B to be amplified thereby. Then, the amplified analog image data are supplied to the display driving circuit 9.

Description will now be given to the operations of the video game machine. As previously stated, when a player (or players) operates the joystick and/or button switches of the operating unit 11, certain operational signals are produced by the operating unit 11. In accordance with these operational signals, the CPU 1 sends suitable command signals (instruction signals) to the sound controller 4 and the video controller 6. Such command-supplying operations by the CPU 1 are performed based on the programs and data stored in the PROM 2.

Based on the command signals from the CPU 1, the sound controller 4 controls the speaker driving circuit 10. Accordingly, the speaker driving circuit 10 will drive the speaker 13, so that background music and sound effects are provided from the speaker 13.

Color codes for each object to be displayed are written in the video RAM 7 by the CPU 1 via the video controller 6 in a predetermined order. Further, under the control of the CPU 1, color specifying data for each pixel of each object are read out from the character ROM 8 and then written in the video RAM 7 in a predetermined order.

Then, the video controller 6 reads out color codes and color specifying data for each pixel from the video RAM 7. The thus read out information is supplied to the look-up table 21 as addresses. As a result, 4-bit first red, green and blue image data and 4-bit first brightness data are output.

The 4-bit first brightness data from the look-up table 21 are supplied to the brightness data modifying circuit 22 as an address. As a result, 9-bit second brightness data are output from the brightness data modifying circuit 22. Here, it should be noted that two data conversion tables are present in the brightness data modifying circuit 22, as previously described with reference to FIG. 3A. The above-mentioned 9-bit second brightness data are output from the brightness data modifying circuit 22 based on selected one of the two conversion tables.

When the first conversion table is used, the resulting second brightness data are linearly varied with respect to the first brightness data, as can be seen from FIG. 3. On the other hand, when the second conversion table is selected, the resulting second brightness data will not vary linearly nor change so greatly as when the first conversion data is selected. For instance, when the first conversion table is used, the second brightness data are changed from "10" to "20" (the difference is ten) as the first brightness data are changed from "0" to "1". However, when the second conversion table is used, the second brightness data are changed from "55" to "59" (the difference is only four) as the first brightness data are changed from "0" to "1".

Referring back to FIG. 2, the 4-bit first red, green and blue image data from the look-up table 21 are supplied to the first, the second and the third multiplying circuits 23R, 23G and 23B, respectively. The 9-bit second brightness data from the brightness data modifying circuit 22 are also supplied to these three multiplying circuits 23R, 23G and 23B.

The 4-bit first red image data are multiplied by the 9-bit second brightness data at the first multiplying circuit 23R, thereby producing 12-bit second red image data. As previously stated, of these 12 bits, only the top 8 bits are supplied to the first D/A converting circuit 24R. The remaining 4 bits (the lower 4 bits) are simply discarded.

Similarly, the 4-bit first green image data and the 4-bit first blue image data are multiplied by the 9-bit second brightness data at the second and the third multiplying circuits 23G and 23B, respectively. Then, only the top 8 bits of the second green image data are supplied to the second D/A converting circuit 24G, while only the top 8 bits of the second blue image data are supplied to the third D/A converting circuit 24B.

In the preferred embodiment, the second brightness data are rendered 9-bit data. With such an arrangement, the second brightness data can be varied in various ways in accordance with the change of the first brightness data. In addition, it is possible to minimize errors in multiplying operation at the first to the third multiplying circuits 23R, 23G and 23B.

The 8-bit second red, green and blue image data output from the first to the third multiplying circuits 23R, 23G and 23B are converted into analog image signals by the first to the third D/A converting circuits 24R, 24G and 24B, respectively. Then, the converted red, green and blue image signals are amplified by the first to the third amplifiers 25R, 25G and 25B for output to the display driving circuit 9.

Upon receiving the amplified image signals, the display driving circuit 9 drives the display unit 12. As a result, animated and/or stationary characters will be displayed on the screen of the display unit 12. When the video game is not being played, the CPU 1 may cause predetermined demonstration pictures to be shown on the screen, while also causing suitable sound effects to be provided from the speaker 13.

According to the above preferred embodiment, 4-bit first brightness data are converted into second brightness data having greater bits (9 bits). As is easily understood, the 9-bit second brightness data can be varied in a greater number of ways than the 4-bit brightness data. Therefore, it is possible to cause the brightness of displayed characters to change in desired manners (linearly or otherwise) at the time of fade-in or fade-out for example.

Further, in the preferred embodiment, use is made of digital circuits (such as the look-up table 21 and the multiplying circuits 23R–23B) at the stages before data are supplied to the first to the third D/A converting circuits 24R, 24G and 24B. Thus, even when conventionally available D/A converting circuits are used for the first to the third D/A converting circuits 24R, 24G and 24B of the preferred embodiment, it is possible to obtain remarkably accurate image signals. Still further, the video controller 6 can be realized by an ASIC (application specific integrated circuit) for example, which is advantageous in reducing manufacturing costs.

In the preferred embodiment described above, the brightness data modifying circuit 22 and the first to the third multiplying circuits 23R, 23G and 23B are realized by using logic circuits. However, without these circuits, the same functions may be performed by the CPU 1 together with the PROM 2 storing appropriate programs. Alternatively, these programs may be stored in an additional storage medium such as a CD-ROM, as will be described below.

Figure 4:
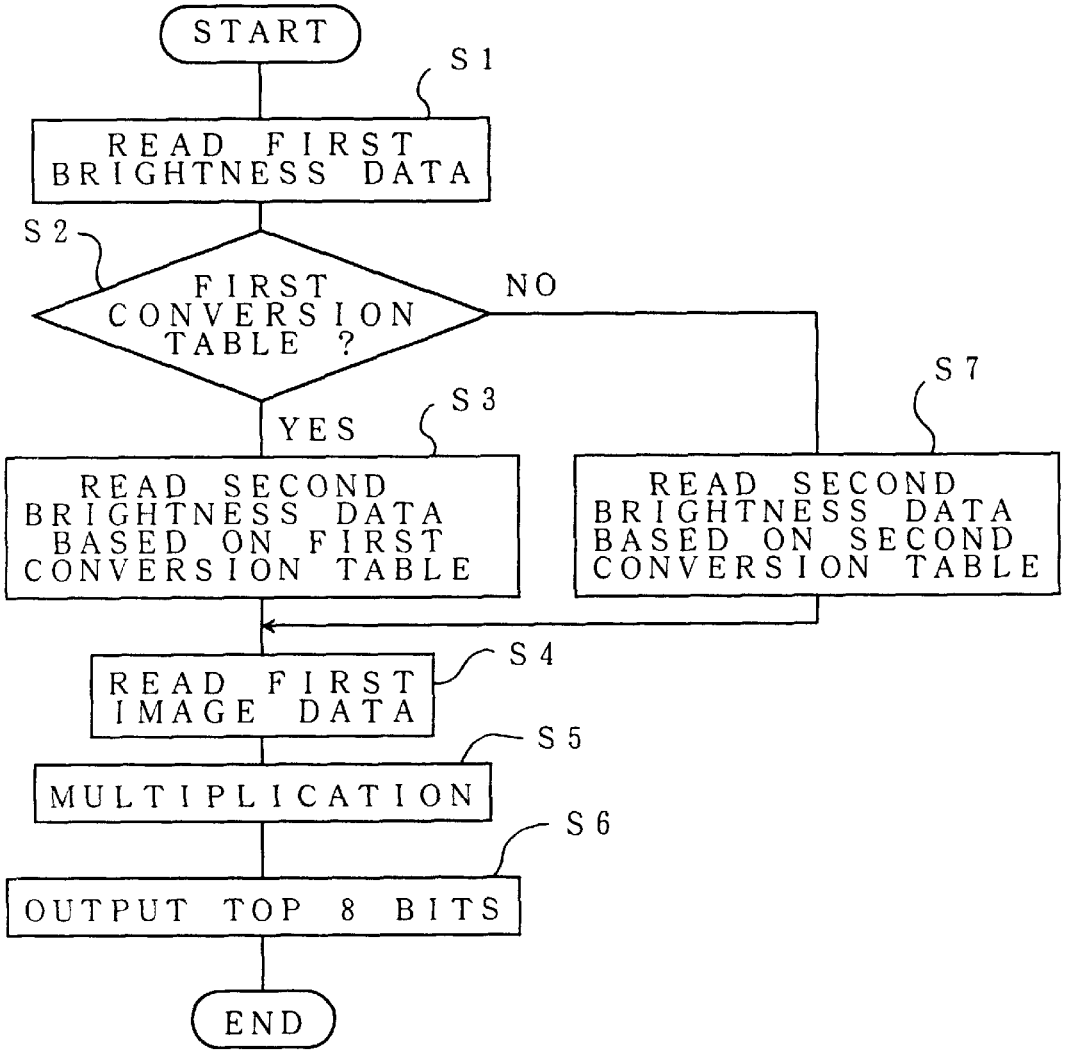
FIG. 4 is a flow chart illustrating the operations of a CPU additionally serving as brightness data modifying means and data multiplying means.
Figure 5A:
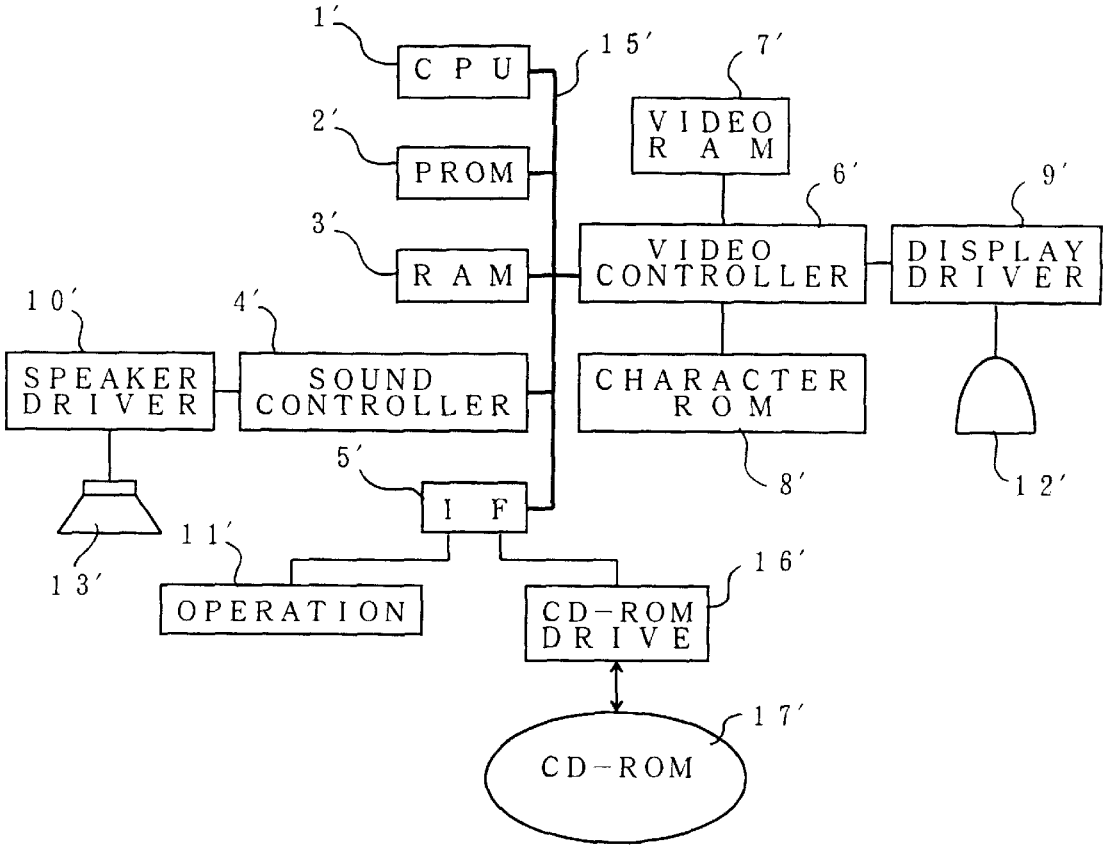
FIG. 5A is a block diagram showing principal components of a different video game machine which incorporates a color image signal generator according to a second embodiment of the present invention.
Figure 5B:
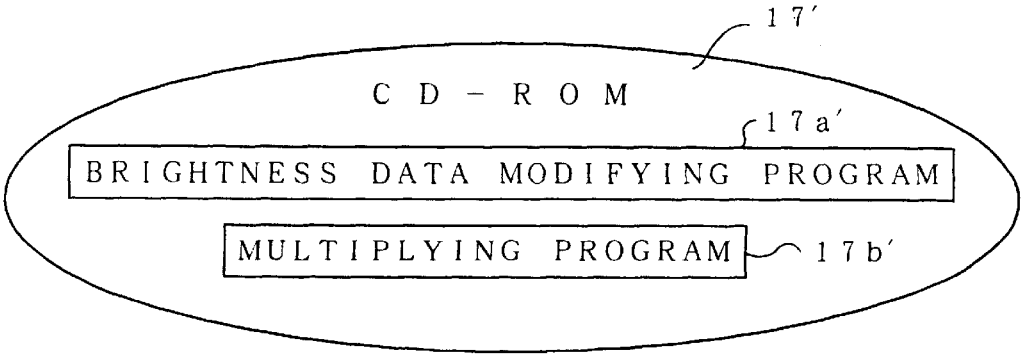
FIG. 5B shows programs stored in a storage medium used for the second embodiment.
Figure 6:
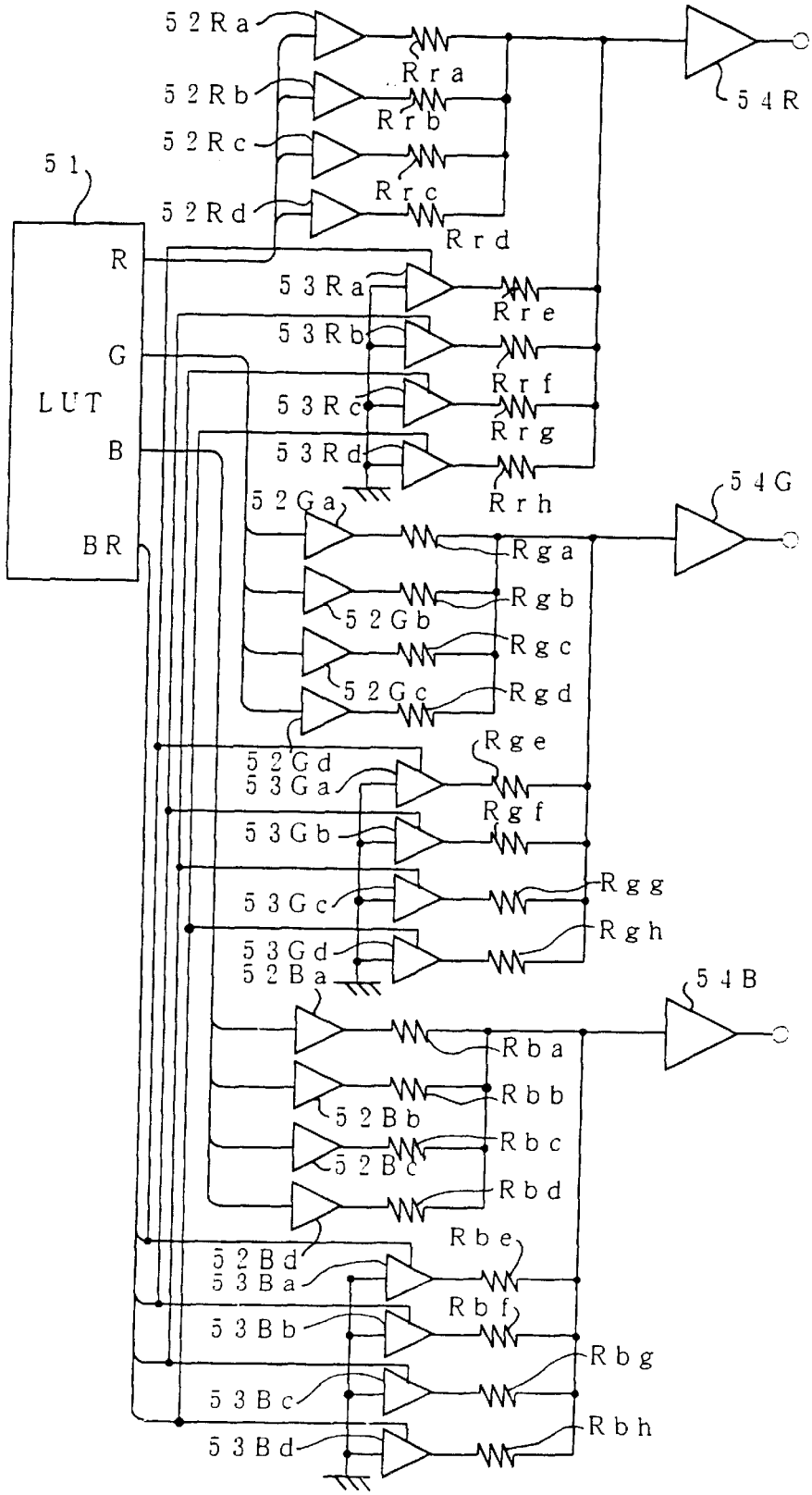
FIG. 6 is a circuit diagram illustrating a comparative example of a color image signal generator.

Reference is now made to FIGS. 4, 5A and 5B. FIG. 4 is a flow chart illustrating operations of a CPU 1' incorporated in a different video game machine schematically shown in FIG. 5A. As can be seen from FIG. 5A, the video game machine of this embodiment is basically similar to the previous machine shown in FIG. 1. Thus, functions or operations similar to those of the previous video game machine will not be described below.

Differing from the previous machine (FIG. 1), the video game machine of FIG. 5A is provided with a CD-ROM drive 16' connected to an interfacing circuit (IF) 5' and a CD-ROM 17' driven by the CD-ROM drive 16'. As shown in FIG. 5B, the CD-ROM 17' stores a brightness data modifying program 17*a*' and a data multiplying program 17*b*'.

Referring to FIG. 4, the CPU 1' reads out first brightness data from a look-up table (not shown) arranged in a video controller 6'. Then, the CPU 1' stores the read-out data in a register file of the CPU 1' (S1). (Here, it is also possible to cause the read-out data to be stored in a RAM 3').

Then, the CPU 1' determines whether or not a first conversion table is to be used (S2). Such determination is made based on a program which may be stored in the CD-ROM 17'. The result of this determination may be maintained through the entire operation of a video game being played, so that only the first conversion table is repeatedly used. Alternatively, the results of the above determination may be rendered different as the video game proceeds, so that the first and the second conversion tables are both utilized.

At Step S2, when the first conversion table is selected (YES), the CPU 1' converts 4-bit first brightness data into 9-bit second brightness data in accordance with the selected first conversion table under the control of the brightness data modifying program 17*a*'. The converted data will be stored in the register file of the CPU 1' (S3). Instead, the same data may be stored in the RAM 3'.

Then, the CPU 1' reads out 4-bit first red, green and blue image data from the look-up table, and stores them in the register file of the CPU 1' (S4). Instead, the same data may be stored in the RAM 3'.

Then, the CPU 1' multiplies the 9-bit second brightness data with each of the 4-bit first red, green and blue image data (S5) under the control of the data multiplying program 17*b*'. As a result, 12-bit second red, green and blue image data are obtained. These data are stored in the register file of the CPU 1'. Instead, the same data may be stored in the RAM 3'.

Finally, the CPU 1' supplies the top 8 bits of the respective 12-bit second red, green and blue image data to first to the third D/A converting circuits (S6) under the control of the data multiplying program 17*b*'.

At Step S2, when the first conversion table is not selected (NO), the CPU 1' converts the 4-bit first brightness data into 9-bit second brightness data in accordance with the second conversion table stored in the PROM 2' (S7) under the control of the brightness data modifying program 17*a*'. The converted second brightness data are stored in the register file of the CPU 1'. Then, the procedure goes to Step S4. The second brightness data may be stored in the RAM 3, instead.

In the preferred embodiments described above, two conversion tables are selectively used for converting the first brightness data into the second brightness data. However, use may be made of only one conversion table. Alternatively, more than two conversion tables may be usable.

The present invention being thus described, it is obvious that the same may be varied in many other ways. Such variations should not be regarded as a departure from the spirit and scope of the present invention, and all such modifications as would be obvious to those skilled in the art are intended to be included within the scope of the following claims.

What is claimed is:

1. A color image signal generator for generating red, green and blue analog image signals based on first red, green and blue image data and on first brightness data, each of the first red, green and blue image data having a predetermined first bit number, the first brightness data having a predetermined second bit number, the color image signal generator comprising:

a brightness data modifier for providing second brightness data based on the first brightness data, the second brightness data having a predetermined third bit number which is greater than the second bit number;

a data multiplier arranged to multiply the second brightness data with the first red, green and blue image data for output of second red, green and blue image data, each of the second red, green and blue image data having a fourth bit number which is greater than the first and the third bit numbers; and a digital-to-analog converter for converting predetermined top bits of each of the second red, green and blue image data into analog signals.

2. The color image signal generator according to claim 1, wherein the first bit number is equal to the second bit number.

3. The color image signal generator according to claim 1, wherein the brightness data modifier is provided with at least one data conversion table for changing the first brightness data to the second brightness data.

4. The color image signal generator according to claim 1, wherein the brightness data modifier is provided with a plurality of data conversion tables for changing the first brightness data to the second brightness data.

5. The color image signal generator according to claim 4, further comprising a conversion table selector for selecting one data conversion table among the plurality of data conversion tables.

6. The color image signal generator according to claim 5, wherein the conversion table selector comprises a register.

7. The color image signal generator according to claim 1, wherein the brightness data modifier is provided with at least one numerical formula for changing the first brightness data to the second brightness data.

8. The color image signal generator according to claim 1, wherein the brightness data modifier is provided with a plurality of numerical formulas for changing the first brightness data to the second brightness data.

9. The color image signal generator according to claim 1, wherein the brightness data modifier comprises a brightness data modifying circuit.

10. The color image signal generator according to claim 1, wherein the data multiplier comprises three multiplying circuits for the first red, green and blue image data.

11. The color image signal generator according to claim 1, wherein the digital-to-analog converter comprises three digital-to-analog converting circuits for the second red, green and blue image data.

12. A video game machine comprising a color image signal generator for generating red, green and blue analog image signals based on first red, green and blue image data and on first brightness data, each of the first red, green and blue image data having a predetermined first bit number, the first brightness data having a predetermined second bit number, the color image signal generator includes:

a brightness data modifier for providing second brightness data based on the first brightness data, the second brightness data having a predetermined third bit number which is greater than the second bit number;

a data multiplier arranged to multiply the second brightness data with the first red, green and blue image data for output of second red, green and blue image data, each of the second red, green and blue image data having a fourth bit number which is greater than the first and the third bit numbers; and a digital-to-analog converter for converting predetermined top bits of each of the second red, green and blue image data into analog signals.

13. The video game machine according to claim 12, further comprising a CPU for controlling the video game machine.

14. The video game machine according to claim 13, wherein the CPU serves as the brightness data modifier and the data multiplier.

15. A storage medium for storing programs to control a color image signal generator used for generating red, green and blue analog image signals based on first red, green and blue image data and on first brightness data, each of the first red, green and blue image data having a predetermined first bit number, the first brightness data having a predetermined second bit number, the storage medium comprising:

a brightness data modifying program for providing second brightness data based on the first brightness data, the second brightness data having a predetermined third bit number which is greater than the second bit number; and a data multiplying program for multiplying the second brightness data with the first red, green and blue image data for output of second red, green and blue image data, each of the second red, green and blue image data having a fourth bit number which is greater than the first and the third bit numbers.

16. The storage medium according to claim 15, wherein the data multiplying program also serves to supply top bits of the second red, green and blue image data to a digital-to-analog converter of the color image signal generator.

17. The storage medium according to claim 15, wherein the storage medium comprises a CD-ROM.

* * * * *